United States Patent [19]

Guenther et al.

[11] 4,144,597

[45] Mar. 20, 1979

[54] TOILET SUPPORT

[75] Inventors: Harold E. Guenther; Kenneth H. Klein, both of Plymouth, Mich.

[73] Assignee: C. D. Sparling Company, Plymouth, Mich.

[21] Appl. No.: 828,044

[22] Filed: Aug. 26, 1977

Related U.S. Application Data

[60] Continuation of Ser. No. 651,966, Jan. 23, 1976, abandoned, which is a division of Ser. No. 404,933, Oct. 10, 1973, abandoned.

[51] Int. Cl.[2] ..... E03D 11/00; A47C 7/54

[52] U.S. Cl. ..... 4/254; 297/417

[58] Field of Search ..... 4/1, 134, 185 R, 185 H, 4/254; 297/411, 412, 414, 417, 118, 348, 422, 36; 248/188.5, 407, 413; D23/48, 49, 53, 69, 71

[56] References Cited

U.S. PATENT DOCUMENTS

| | | | |
|---|---|---|---|
| 709,945 | 9/1902 | Wade | 4/254 |
| 2,536,503 | 1/1951 | Jones | 248/413 |
| 2,766,463 | 10/1956 | Bendersky | 297/411 X |
| 2,774,975 | 12/1956 | Frank | 4/254 |
| 3,011,179 | 12/1961 | Hussey | 4/254 |
| 3,179,071 | 4/1965 | Johnston | 248/407 X |
| 3,474,471 | 10/1969 | Matibag | 4/254 |
| 3,769,638 | 11/1973 | Clanan | 4/134 |

FOREIGN PATENT DOCUMENTS

| | | | |
|---|---|---|---|
| 900699 | 7/1962 | United Kingdom | 297/417 |

*Primary Examiner*—Stuart S. Levy

*Attorney, Agent, or Firm*—Barnes, Kisselle, Raisch & Choate

[57] ABSTRACT

A toilet support for use by invalids and the like wherein one or more arms are mounted on brackets supported adjacent the hinge for the seat of the toilet bowl for movement into and out of operative position such that in one position the arms can be gripped and engaged by the invalid and in another position said arms are out of the way.

1 Claim, 5 Drawing Figures

FIG. 1
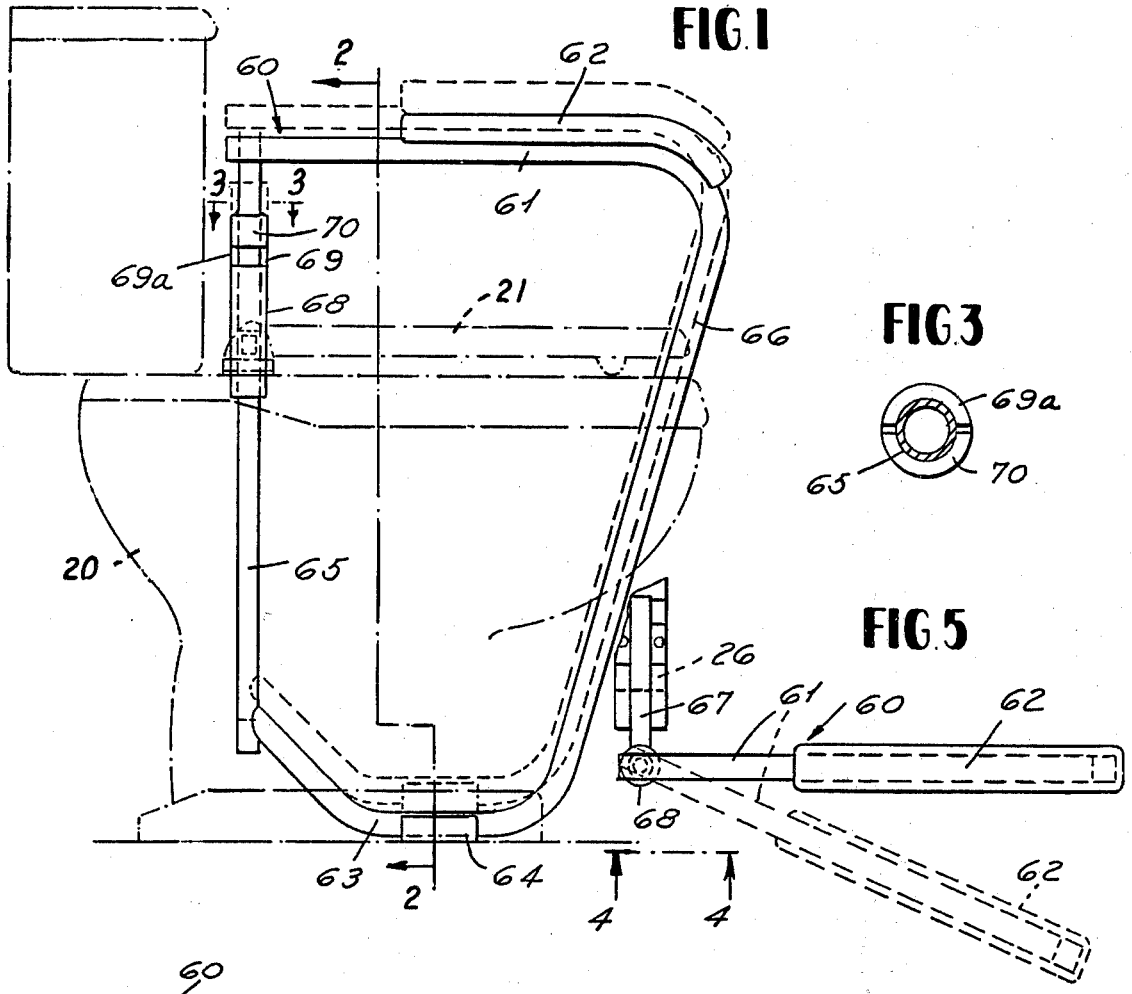
FIG. 3
FIG. 5
FIG. 2
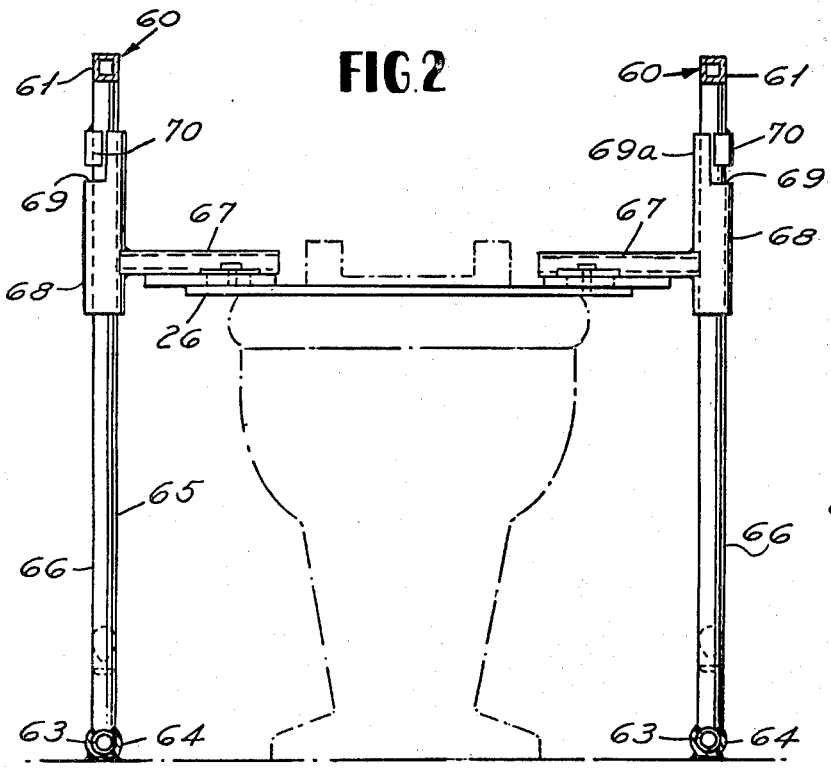
FIG. 4
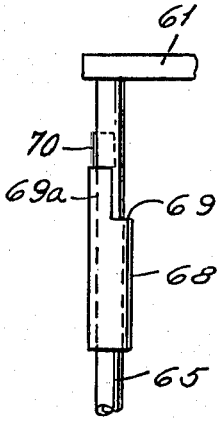

TOILET SUPPORT

This is a continuation of application Ser. No. 651,966, filed Jan. 23, 1976 now abandoned, which is, in turn, a division of application Ser. No. 404,933, filed Oct. 10, 1973, now abandoned.

This invention relates to toilet supports for assisting invalids in the use of a toilet bowl.

BACKGROUND OF THE INVENTION

In both institutions and homes wherein the aged or invalid persons reside, it has become more common for some form of support to be provided for assisting the persons in the use of the toilet facilities. One of the considerations in such devices is that the area surrounding the toilet bowl be readily accessible for seating the person and for cleaning and that the device be sufficiently strong to withstand the weight of the person using it. Among the objects of the invention are to provide toilet supports which utilize the strength of the toilet bowl for supporting part of the weight of the user and which incorporate novel means for providing the bearing; which either keep the area surrounding the toilet bowl free or easily accessible; and which provide a clean easily maintained construction.

SUMMARY OF THE INVENTION

The toilet support embodying the invention comprises one or more arms mounted on brackets supported adjacent the hinge for the seat of the toilet bowl for movement into and out of operated position such that in one position the arms can be gripped and engaged by the invalid and in another position said arms are out of the way. Novel means are provided for supporting the arms that have hand engaging portions for movement into and out of operative position and for ready access to the area surrounding the toilet bowl for cleaning and the like.

DESCRIPTION OF THE DRAWINGS

FIG. 1 is a side elevational view of a toilet support embodying the invention.

FIG. 2 is a sectional view taken along the line 2—2 in FIG. 1.

FIG. 3 is a fragmentary sectional view taken along the line 3—3 in FIG. 1.

FIG. 4 is a fragmentary side elevational view of a portion of the device shown in FIGS. 1-3 showing the parts in a different operative position.

FIG. 5 is a fragmentary plan view of the portion of the apparatus shown in FIGS. 1 and 2.

DESCRIPTION

Referring to FIGS. 1-5, each arm 60 comprises a horizontal portion 61 on which the hand gripping part 62 is mounted, a ground engaging portion 63 having a ground engaging pad 64 and generally vertical side portions 65, 66, the portions 61, 63, 65, 66 being made of tubular material of either round, oval or square cross sections. In this form, the bearing comprises a bracket 67 fixed to plate 26 and having a tube 68 thereon through which the portion 65 extends. Plate 26 is held in position by the same bolts as normally retain the hinge of toilet seat 21 on toilet bowl 20. Tube 68 is formed with a cutaway 69 providing an arcuate projection **69*a* on the upper end thereof. A complementary arcuate projection 70 is welded on the tube portion 65 thereby providing a bayonet connection. In the solid line position shown in FIG. 1, the projection 70 extends into the space formed at the cutaway portion 69. However, when the arm 60 is raised to the broken line position shown in FIG. 1, the projection 70 clears the projection 69*a* at the upper end of the tube 68 so that when the arm 60 is swung away from the toilet bowl to the broken line position shown in FIG. 1, the projection 70 engages the projection 69*a* on the upper end of the tube 68 holding the arm 60 in its vertically raised outwardly swung position so that the ground engaging portion and particularly the pad 64 is elevated from the floor providing access to the area surrounding the toilet bowl (FIGS. 4, 5) As shown, the projection 69*a* faces inwardly toward the toilet bowl thereby facilitating cleanliness by keeping the cutaway portion 69** facing away from the toilet bowl.

We claim:

1. In a toilet support for use with a toilet bowl, the combination comprising a toilet bowl, a toilet seat pivoted to said toilet bowl about a horizontal axis, an arm having a hand gripping portion, said arm having a ground engaging portion, means mounted on said toilet bowl adjacent said pivotal axis of said toilet seat to said toilet bowl for solely supporting said arm for pivotal movement of said hand engaging portion and said ground engaging portion about a generally vertical axis, said means adjacent said pivotal axis of said toilet seat being operable to hold said arm in a first position wherein said hand engaging portion is in an operative position adjacent said toilet bowl and said ground engaging portion engages the ground and a second position wherein said hand engaging portion is in an inoperative position away from the toilet bowl and the ground engaging portion is elevated and supported solely by said mounting means out of contact with the ground, wherein said means for supporting said arm comprises a first generally vertical portion forming a part of said arm, a second generally vertical portion telescopically receiving said first portion and mounted on said toilet bowl, said second portion having a cut away portion defining a vertical slot, said first portion having a vertical projection thereon, said projection extending into said slot when said arm is in operative position and said ground engaging portion contacts the ground, said projection engaging the upper end of said second portion when said arm is in inoperative position thereby holding said ground engaging portion out of contact with the ground.

* * * * *